United States Patent [19]

Djordjevic et al.

[11] Patent Number: 4,811,715

[45] Date of Patent: Mar. 14, 1989

[54] ELECTRONIC UNIT INJECTOR

[75] Inventors: Ilija Djordjevic, Windsor; William W. Kelly, Granby; Richard E. Vanderpoel, Bloomfield, all of Conn.

[73] Assignee: Stanadyne, Inc., Windsor, Conn.

[21] Appl. No.: 115,845

[22] Filed: Nov. 2, 1987

[51] Int. Cl.[4] ..... F02M 34/00

[52] U.S. Cl. ..... 123/447; 123/496; 123/446; 123/506

[58] Field of Search ..... 123/496, 506, 447, 446, 123/458

[56] References Cited

U.S. PATENT DOCUMENTS

| | | | |
|---|---|---|---|
| 4,029,071 | 6/1977 | Saito | 123/496 |
| 4,211,203 | 7/1980 | Kobayashi | 123/496 |
| 4,526,149 | 7/1985 | Hafele | 123/447 |
| 4,526,150 | 7/1985 | Guntert | 123/447 |
| 4,622,942 | 11/1986 | Nozaki | 123/447 |
| 4,718,384 | 1/1988 | Takahashi | 123/496 |

FOREIGN PATENT DOCUMENTS

| | | | |
|---|---|---|---|
| 2136885 | 9/1984 | United Kingdom | 123/447 |

*Primary Examiner*—Carl S. Miller

*Attorney, Agent, or Firm*—Chilton, Alix & Van Kirk

[57] ABSTRACT

An electronic unit injector employs an expandable chamber which expands as pressure in the injector increases between a pair of threshold pressures. The expansion of the chamber results in a two-phase rate of injection of the injector whereby the initial injection rate is significantly lower than the second injection rate. In one embodiment, the expandable chamber is formed by a pin which is displaceable in a cap mounted to the injector body. The pin bottoms against the cap to define the phase transition.

17 Claims, 5 Drawing Sheets

ELECTRONIC UNIT INJECTOR

BACKGROUND OF THE INVENTION

The present invention relates generally to internal combustion fuel injection systems. More particularly, the present invention relates to unit injectors employed in fuel injection systems.

In fuel injection systems to which the present invention relates, a pump plunger pressurizes fuel within an injector. When the fuel reaches a sufficient pressure, a valve is lifted from a valve seat and pressurized fuel is injected through a discharge orifice of the injector nozzle. The pump plunger directly or indirectly follows a cam profile of an injection train to pressurize fuel within the injector. The fuel is injected into the engine cylinder for a period of time prior to combustion. The latter time period is often referred to as the ignition delay period. At the expiration of the ignition delay period, a portion of the injected fuel which has fully mixed with intake air combusts in a relatively spontaneous manner. This uncontrolled combustion results in high combustion noise and the generation of a relatively high quantity of oxides of nitrogen emissions. Because of increasing governmental and regulatory demands to control emissions and increase fuel economy, newer engine design parameters tend to require higher injection pressures and shorter durations for the injected charges. The implementation of limitations on the quantity of fuel which is injected during the ignition delay period is desirable for high pressure/short duration fuel charges.

U.S. patent application Ser. No. 854,047 filed Apr. 21, 1986 entitled "Method and Apparatus for Regulating Fuel Injection Timing and Quantity" and assigned to the assignee of the present invention discloses a fuel injection system which employs a solenoid valve for precisely regulating the fuel injection timing. The intake charge quantity of fuel supplied through a charge pump is precisely regulated during each intake stroke and the quantity of injected fuel is precisely regulated by a spill termination of the high pressure delivery. During each stroke an electronic controller having a data processor energizes and deenergizes the solenoid valve for adjusting the fuel injection timing and the quantity of fuel in the injected charge.

U.S. Pat. No. Re. 30,189 of Julius P. Perr entitled "Fuel Injection System For Diesel Engines" discloses an injection rate control device employing an auxiliary spring which is connected in line with the conventional injection train to operate an injector plunger in synchronism with the rotation of a cam shaft. The auxiliary spring has a lower spring rate than that of the injection train so that the injector plunger advances at a different rate when it is under the control of the auxiliary spring. Means are included for rendering the auxiliary spring ineffectual during a portion of the plunger advancement. The rate of plunger advance is controlled by the auxiliary spring during the initial portion of the advancing stroke and by the conventional injection train during the balance of the advancing stroke. The auxiliary spring automatically varies the ignition timing and the injection rate. Fuel may be injected into the cylinder at a relatively slow rate during an initial phase of the ignition delay interval and at a fast rate during the balance of the injection stroke of the injector plunger.

SUMMARY OF THE INVENTION

The present invention is a new and improved electronic unit injector for a fuel injection system which provides a two-phase rate of injection so as to limit the quantity of fuel injected during the ignition delay period.

Briefly stated, the invention in a preferred form is an electronic unit injector having an injector body which forms a fuel inlet, an injector chamber and an inlet passage which connects the fuel inlet and the injector chamber. A nozzle defines a nozzle chamber which fluidally communicates with the injector chamber. The nozzle includes a discharge orifice and a valve seat. A needle valve is mounted in the nozzle. The needle valve is axially displaceable in response to pressure above a first pre-established threshold. In the closed position, the needle valve sealingly engages the valve seat to prevent the discharge of fuel through the orifice. In the opened position, the pressurized fuel in the nozzle chamber discharges through the orifice. A plunger is displaceable in the injector chamber for pressurizing fuel therein. An expandable fuel subtraction chamber communicates with the injector chamber. The volume of the expandable fuel subtraction chamber increases as the pressure in the injector increases between second and third threshold pressures.

A solenoid valve assembly is mounted to the injector body. The solenoid valve is actuable between first and second positions for selectively controlling the fuel communication through the inlet passage. In the first position, fuel fills the injector chamber and displaces the plunger at least partially from the injector chamber. In a second position, fuel communication to the injector chamber is closed and the plunger is displaceable to pressurize fuel in the injector chamber. When the pressure of fuel in the injector exceeds a pre-established injection threshold pressure, fuel is discharged through the discharge orifice in a two-phase fuel injection sequence which is terminated by actuating the solenoid valve to the first position.

The expandable fuel subtraction chamber is in one possible embodiment partially defined by a pin which is displaceable for varying the volume of the fuel subtraction chamber. A cap is mounted to the injector body. The pin engages the cap at the third threshold pressure. The cap also interiorly defines an auxiliary accumulator chamber. The auxiliary accumulator chamber receives pressurized fuel which leaks past the pin from the fuel subtraction chamber.

During the initial injections period some fuel is diverted to the subtraction chamber in proportion to the increase in injector pressure. The division terminates at the third threshold pressure. The pin displacement and volume of fuel trapped in the auxiliary accumulator chamber determine the rate of the diversion and the total quantity of diverted fuel.

The solenoid valve comprises a spool valve and a solenoid drive which controls the position of the spool valve. Upon energization of the solenoid, the spool valve closes a port formed in the inlet passage. The spool valve opens the port to fill the injector and also re-opens the port to spill fuel from the injector for terminating fuel injection.

Fuel is injected through the discharge orifices in a two-phase injection sequence. The rate of injection of injected fuel in the first phase is significantly less than the rate of injection of fuel in the second phase. The fuel subtraction chamber is formed in one embodiment by a cap which is mounted to the injector body and a pin which is displaceable in the cap and engageable against an interior end of the cap to define the third threshold pressure. The attainment of the third threshold pressure defines the transition between the first and second phases of the fuel injection event.

An object of the invention is to provide a new and improved electronic unit injector which has an efficient construction for limiting the quantity of fuel injected during the ignition delay period.

Another object of the invention is to provide a new and improved electronic unit injector which has improved means for regulating the timing and the quantity of fuel injected into the engine cylinder.

A further object of the invention is to provide new and improved electronic unit injector which incorporates a spill termination of the injector and incorporates an efficient means within the injector for limiting the quantity of fuel injected during the ignition delay period.

A yet further object of the invention is to provide a new and improved electronic unit fuel injector which injects a high pressure charge of fuel in a controlled manner so as to limit combustion noise and the emissions of oxides of nitrogen upon combustion of the high pressure fuel charge.

Other objects and advantages of the invention will become apparent from the specification and the drawing.

DETAILED DESCRIPTION OF THE INVENTION

Figure 1:
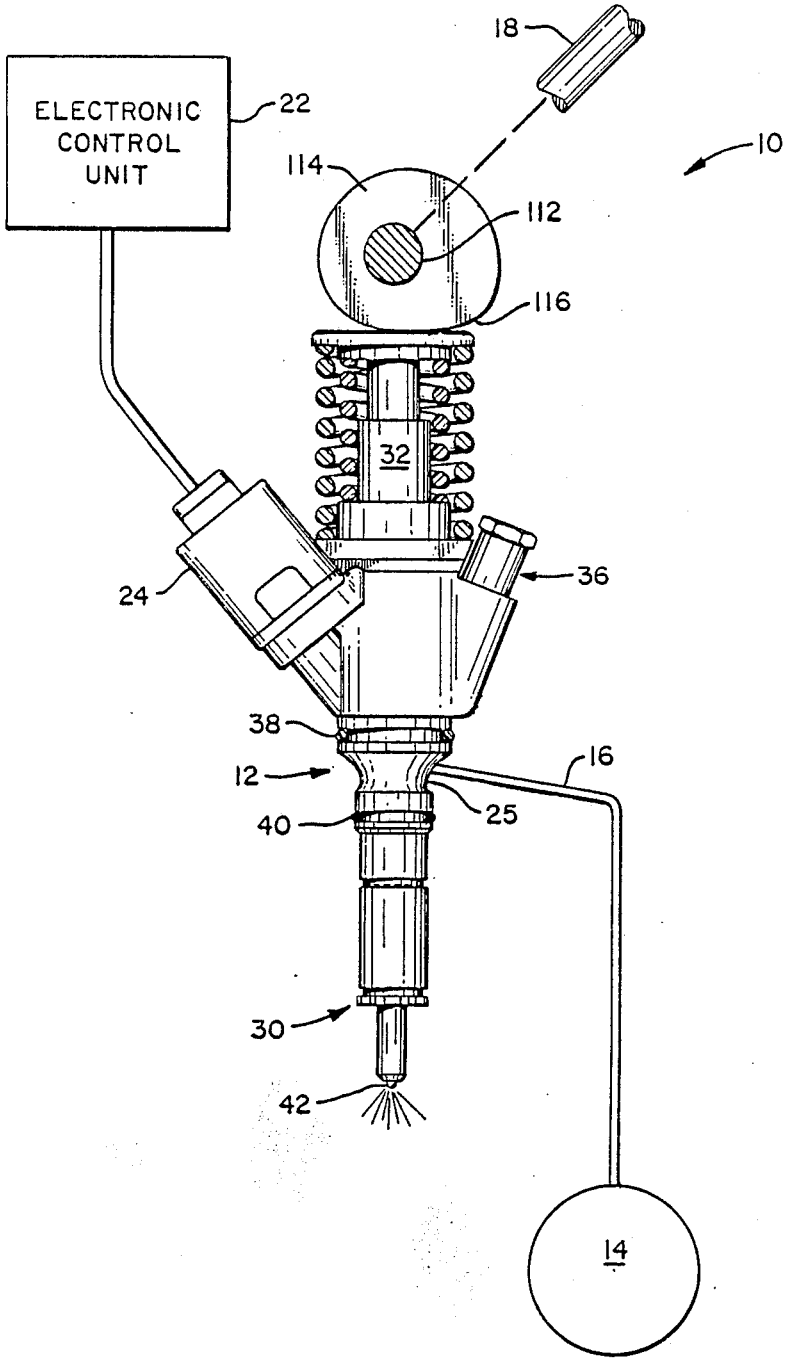
FIG. 1 is a schematic view of a fuel injection system employing an electronic unit injector in accordance with the present invention, said injector being illustrated in a side elevational view which is partially broken away.

With reference to the drawings wherein like numerals represent like parts throughout the figures, a fuel injection system generally designated by the numeral 10 in FIG. 1 functions to inject high pressure charges of fuel into the cylinders of an internal combustion engine (only partially illustrated). The fuel injection system 10 comprises an electronic unit injector 12 in accordance with the present invention. An injector 12 is mounted in an installation bore 13 (FIG. 3) of each engine cylinder for sequentially synchronously injecting the high pressure charges of fuel. Conventional means (not illustrated) are employed for supplying fuel to each of the injectors.

A suitable pump is employed for continuously supplying pressurized fuel via supply conduit 16 to an inlet 20 of the injector. The injector draws fuel by demand. An injector train of conventional form designated generally by the numeral 18 mechanically actuates the injector in synchronism with the engine for pressurizing fuel supplied to the injector. An electronic control unit 22, which may incorporate a micro-processor, electronically controls the operation of the injector by selectively energizing a solenoid valve unit 24 to regulate the injection timing and to terminate the injection to thereby control the quantity of fuel injected into the engine cylinder in a given pressurized charge.

Figure 3:
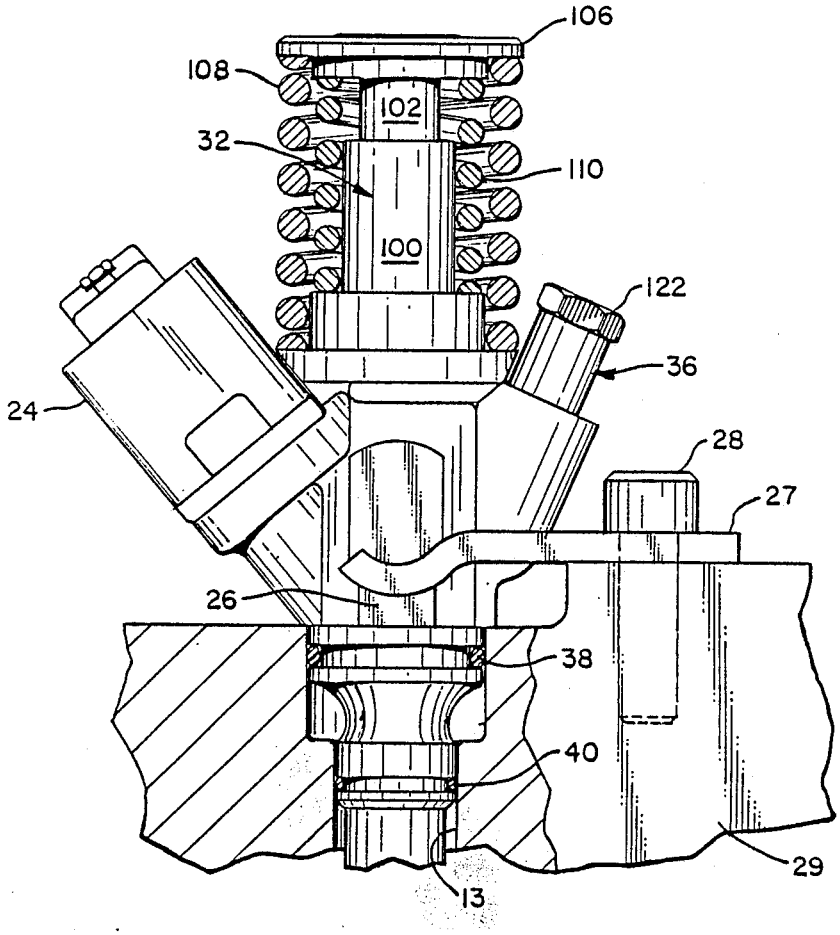
FIG. 3 is an enlarged fragmentary sectional view of a portion of the injector of FIG. 1 mounted at the cylinder block of an associated internal combustion engine.

With reference to FIG. 3, the electronic unit injector 12 includes an axially extending injector body 25 (FIG. 1) which at an intermediate axial location forms a pair of opposing lateral shoulders 26. A U-shaped mounting plate 27 or clamp bracket is laterally received by the shoulders. A bolt 28 extends through the plate 27 and threads to the cylinder block 29 for clamping the injector in the installation bore 13 at the engine cylinder.

With reference to FIG. 1, the injector body 25 integrally mounts and/or or receives the solenoid valve unit 24, a nozzle assembly 30, a plunger assembly 32, and an separate subtraction chamber unit 36. The nozzle assembly 30 and the plunger assembly 32 are in general axial alignment with the central axis of the injector body. The solenoid unit 24 and the subtraction chamber unit 36 project from the injector body at an oblique angle to the central axis. The exterior of the injector body forms a plurality of axially spaced circumferential grooves which receive O-rings 38 and 40 for sealing the injector in the installation bore 13 at the engine cylinder.

Figure 2:
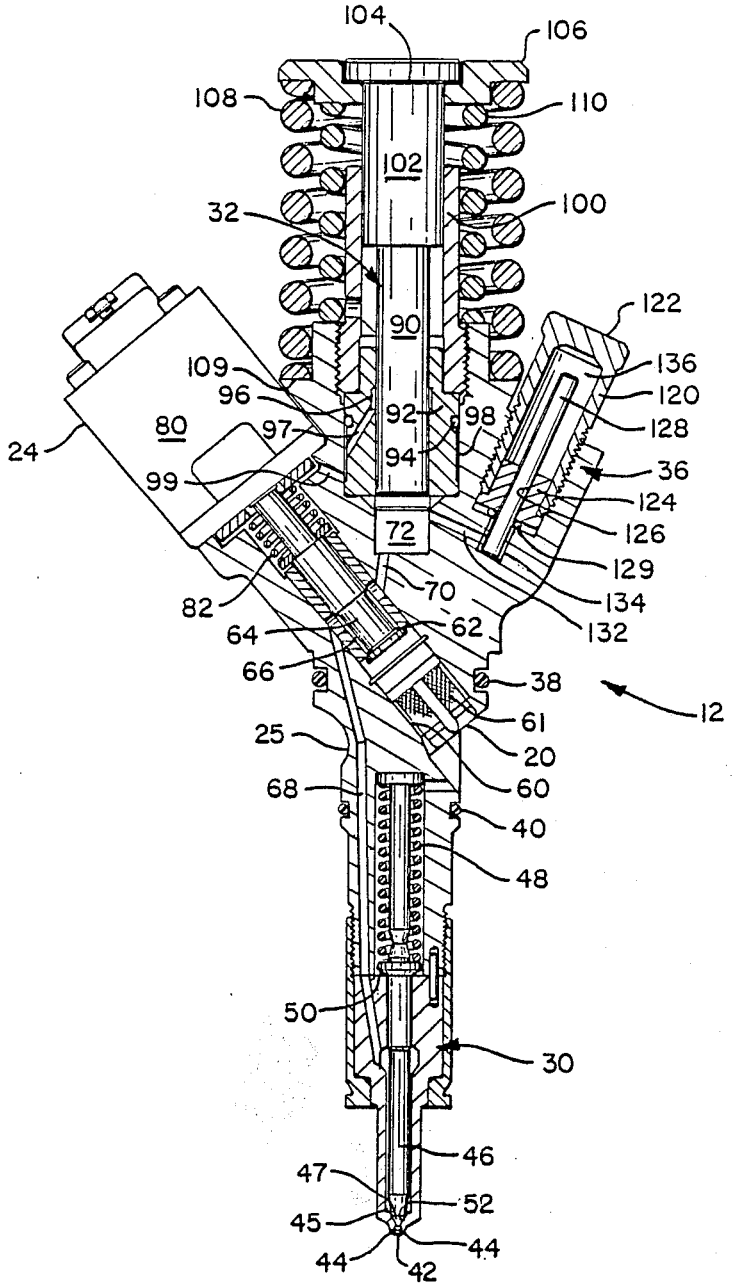
FIG. 2 is an enlarged side sectional view of the unit injector of FIG. 1.

The nozzle assembly 30 includes a nozzle 42 which has one or more discharge orifices 44 at the lower tip thereof. With additional reference to FIG. 2, the nozzle forms a nozzle chamber 45 which receives a valve needle 46 having a tapered sealing end 47. Upon reception of the valve needle, the resultant nozzle chamber 45 has a relatively small dead volume. A helical compression spring 48 biases against an intermediate shoulder 50 of the valve needle to normally bias the end 47 of the needle into sealing engagement at the valve seat 52 formed interiorly at the tip of the nozzle. The valve needle 46 functions in a conventional manner wherein when the pressure of fuel in the chamber 45 exceeds a pre-established pressure threshold defined by the spring 48, the valve needle is momentarily axially displaced from the valve seat to permit injection of pressurized fuel from the nozzle chamber 45 through the orifices 44 into the cylinder of the engine. The injection charge is terminated by the pressure in the nozzle chamber 45 decreasing below the closing pressure threshold and the spring 48 rapidly returning the valve needle to the closed position.

A diagonally oriented inlet bore 60 disposed above the nozzle assembly forms an inlet opening 20 which connects with the supply conduit 16 for supplying pressurized fuel under a pressure typically on the order of 50 psi. A filter screen 61 is preferably disposed at the inlet portion of bore 60. An interior port 62 which communicates with the inlet opening 20 is selectively opened and closed by a spool valve 64. The spool valve 64 forms an annulus 66 which communicates via a passage 68 with the nozzle chamber 45. A second passage 70 connects the annulus 66 with a plunger chamber 72 for pressurizing received fuel.

The position of the spool valve 64 is electronically controlled by means of a solenoid actuator 80. The spool valve 64 is normally open. The solenoid 80 energizes the valve to close the port 62 to terminate fluid communication through the port between the inlet bore and the passages 68 and 70. A spring 82 biases the spool valve 64 to the normally opened position. The spring 82 has an opening force typically on the order of 10–14 pounds for rapidly returning the spool valve to the opened position The solenoid receives electrical inputs from the electronic control unit 22 to control opening and closing of the spool valve. The solenoid valve opens to fill the injector with fuel, closes to permit pressurization within the injector, and re-opens to form a spill or pressure relief path for terminating fuel injection.

A pump plunger 90 is displaceable in the plunger chamber 72 to pressurize fuel in the injector. The pressurization results 17 in the pressure in the nozzle chamber 45 exceeding the pre-established injection threshold defined by the valve needle spring 48 to permit injection of the pressurized fuel. A guide sleeve 92 is received in a central upper opening of the injector body for receiving the axially displaceable plunger 90. An O-ring 94 seals the sleeve with the injector body. A leak off annulus 96 is formed interiorly of the sleeve and is partially defined by the plunger. A diagonal leak off passage 97 returns fuel which leaks between the plunger 90 and the sleeve 92 via annulus 98 and passage 99 to the inlet bore 60 to thereby form a fuel return system.

A second sleeve 100 is threaded to the injector body to lock the guide sleeve 92 in position. Sleeve 100 has an interior cylindrical surface which functions as a guide surface for a tappet 102. The tappet 102 and the plunger 90 are generally coaxial with the lower end of the tappet being engageable against the top of the plunger 90. The upper portion of the tappet forms a circumferential shoulder 104 which functions as a stop to engage against a recessed lip of an axially biased, bi-level tappet plate 106 for axial retention thereof. The tappet plate is biased outwardly (upwardly in the drawings) by means of a spring 108 which acts between the underside of the tappet plate 106 and an annular exterior shoulder 109 of the injector body. The tappet plate 106 may be biased by more than one spring depending on the engine speed and the mass of the linkage between the cam and the injector. An auxiliary spring 110 generally coaxial with the spring 108 encircles the sleeve 100 and biases between an annular flange of the injector body and a lower underside portion of the tappet plate 106.

The mechanical injector train 18 comprises a cam shaft 112 which mounts a cam 114. The cam 114 has a cam surface 116 which defines a generally constant pressurization rate of the plunger 90 and allows for a relatively slow constant fill of the plunger chamber 72. The tappet plate 106 is responsive to the angular position of the cam shaft 112 via the cam surface 116 so as to define the axial position of the plate 106. The springs 108 and 110 bias the tappet plate 106 and hence the tappet 102 into riding engagement with the cam 114. It will be appreciated that the plunger axially engages against the tappet in accordance with the quantity of fuel in the plunger chamber 72. Consequently, the fill time, which is a function of the quantity of fuel which flows to the chamber 72, directly corresponds to the outward (upward) axial displacement of the plunger 90 from the chamber and hence the distance between the underside of the tappet 102 and the outer end of the plunger 90. Therefore, the quantity of fuel in the chamber 72 determines the timing of the injection stroke since the tappet upon actuation by the cam member 114 engages the plunger at a time which is related to the distance between the plunger and the tappet prior to the tappet displacement by the cam member 114.

The subtraction chamber unit 36 comprises an obliquely mounted cap 120 having a hex head 122. The cap 120 is a generally cylindrical member having an exterior threaded surface which threadably engages a complementary threaded counterbore formed in the injector body. A guide sleeve 124 is positioned at the inner end of the cap and is secured in position by the cap. The guide sleeve 124 has a central bore 126 which receives a slidable pin 128. A sealing element 129 seals the end of the sleeve 124 with the injector body. An auxiliary passage 132 communicates between the plunger chamber 72 and an expandable fuel subtraction chamber 134. The pin 128 is receivable in the subtraction chamber 134 and displaceable therein for expanding the volume of the chamber 134. The cap interiorly forms an accumulator chamber 136. The pin 128 is displaced outwardly toward the end of the cap in response to the plunger produced pressurization of fuel in the chamber 134 which is exerted against one end of the pin. Increasing pressurization displaces the pin 128 until the pin bottoms against the cap to thereby limit any further displacement of the pin. A small quantity of pressurized fuel will ordinarily leak past the pin 128 into the accumulator chamber 136. The opposite end of the pin is exposed to pressure in chamber 136 for returning the pin to the retracted position upon spilling pressure from the injector.

In operation, pressurized fuel supplied via conduit 16 enters the inlet bore 60 and flows through port 62 into annulus 66. The supplied fuel typically has a pressure of 50 psi. The pressurized fuel flows via passage 68 to nozzle chamber 45 and via passage 70 to plunger chamber 72. The solenoid 80 is not energized and the spool valve momentarily remains in an opened position to fill the injector. As the pressurized fuel continues to fill chamber 72, plunger 90 is displaced outwardly (upwardly). The pin 128 generally bottoms against the chamber 134 at the end of the spill termination phase, and is bottomed in chamber 134 at the initiation of the fill phase.

The solenoid is then energized to close the spool valve 64. As the cam shaft 112 rotates, the cam surface 116 engages the tappet 102 to force the tappet inwardly against the plunger 90. The plunger is displaced inwardly thereby pressurizing fuel in the pump chamber 72 as the cam surface rotatably engages against the tappet.

When the filling is completed, the tappet continues to follow the cam profile until the inward most position is attained. Afterwards the direction of motion of the tappet reverses creating a gap between the tappet and the plunger. Pressurization commences when the gap between the tappet and plunger is eliminated. The outward plunger displacement terminates when filling is completed (interrupted).

As the injector pressure increases, the pressure in auxiliary chamber 134 increases, and pin 128 is forced outwardly (upwardly) toward the end of cap 120 chamber thereby expanding the volume of chamber 134 (and the dead volume of the injector). A corresponding pressure increase also occurs in nozzle chamber 45. When the pressure reaches a pre-established injection threshold, the valve needle is displaced from the valve seat to allow pressurized fuel to flow through the injector orifices 44 into the engine cylinder.

The plunger 90 continues its inward displacement and the injector pressure continues to rise. The fuel subtraction gradually increases until the pin 128 bottoms against the cap 120 The dead volume within the injector is now fixed. A dramatic increase in the injector system pressure thus results in an enhanced fuel pressure for the fuel charge which is injected through the orifice 44 into the cylinder. Consequently, a two-phase injection takes place whereby the initial phase has a relatively low injection pressure (low rate of fuel injection) and the second phase initially defined by the pin bottoming against the accumulator cap has a dramatically increased injection pressure (high rate of fuel injection).

The injection charge is terminated by opening the spool valve 64 to thereby spill the pressurized fuel through the inlet 20. Upon opening the spool valve 64, the valve needle is rapidly biased to its seated closed position to terminate the fuel injection. The valve closing is supported by a pressure spike. The pressure of the fuel which leaks past pin 128 into accumulator chamber 136 exceeds the residual pressure in subtraction chamber 134 to return the pin to the retracted position illustrated in FIG. 2.

Figure 4:
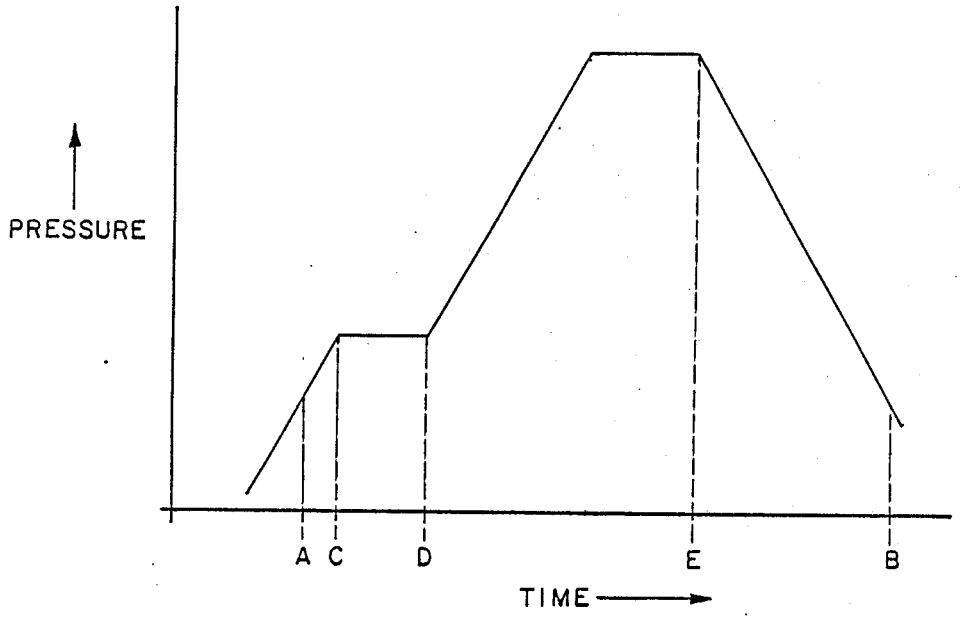
FIG. 4 is a graph illustrating the pressure/time characteristics for the injector of FIG. 1.

The two-phase injection rate characteristic is illustrated in FIG. 4 which graphically illustrates in somewhat idealized fashion the injection pressure and the injection time sequence for one example of unit injector 12. The injector valve 46 initially opens at time A and closes at time B. The pressure generally gradually increases from approximately 3,500 psi to 6,000 psi. At time C the pressure briefly stabilizes at 6,000 psi due to the pin 128 being displaced to expand the volume of the fuel subtraction chamber 134. The pressure increases slightly from time C to time D at which time the pin 128 bottoms against cap 120 and the dead volume of the injector remains constant (at approximately the termination of the ignition delay period). A second increase occurs at time D wherein the pressure may increase to, for example, 16,000 psi prior to the re-opening of the spool valve at time E to spill the fuel from the injector to terminate the injection at time B.

Figure 5:
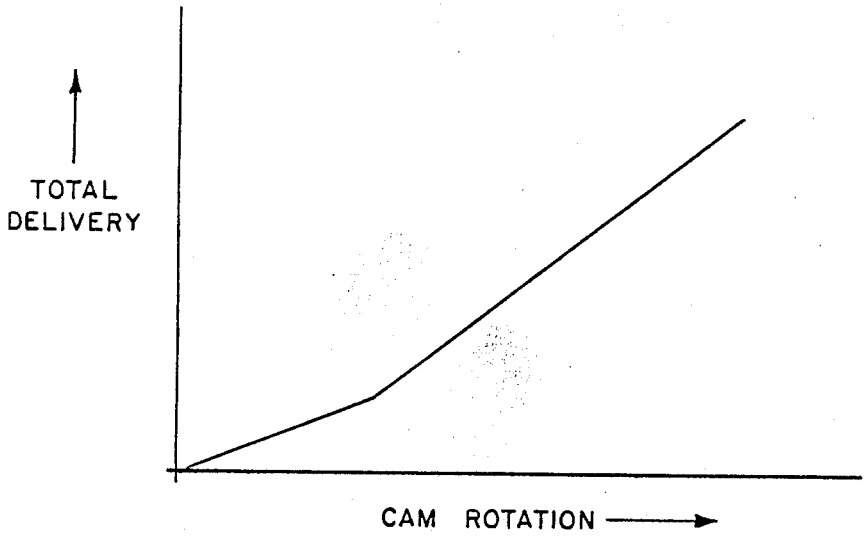
FIG. 5 is a graph illustrating the fuel delivery as function of cam rotation for the fuel injection system of FIG. 1.
Figure 6:
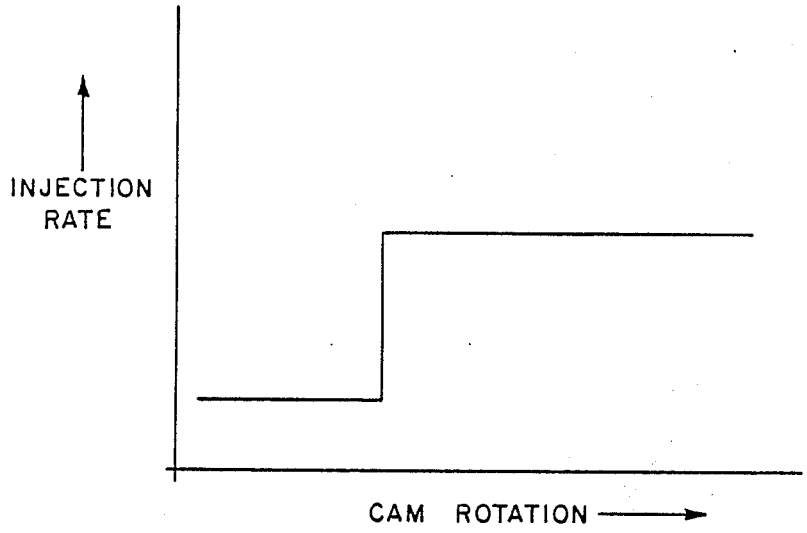
FIG. 6 is a graph illustrating the injection rate as a function of cam rotation for the fuel injection system of FIG. 1.

FIG. 5 graphically illustrates the total fuel delivering of the unit fuel injector 12 as a function of cam rotation. FIG. 6 graphically illustrates the instantaneous rate of fuel injection for injector 12 as a function of cam rotation.

It will be appreciated that the pin 128 and the accumulator cap 120 may be dimensioned so that the bottoming or engaging of the pin against the underside of the fuel cap occurs at the end of the ignition delay period or another selected time of the injection event. Therefore, the quantity of fuel injected into the cylinder may be significantly limited in the ignition delay period and dramatically increased during the period of combustion and subsequently thereafter. Consequently, the amount of uncontrolled combustion is significantly reduced, and combustion noise and the emission of oxides of nitrogen is limited.

It will also be appreciated that the solenoid 80 is selectively energized so as to regulate the timing of the injector by controlling the quantity of fuel, i.e., the time period during which the pressurized fuel fills the pump chamber 72. The quantity of injected charge is regulated by the time interval between the closing of the valve and the re-opening of the spool valve 64 to spill the pressurized fuel. The injector displays insubstantial cavitation since the spool valve is disposed between the plunger and the nozzle. The leakage of the pressurized fuel into the accumulator chamber assures that the pin will return to its retracted position for the next injection sequence. It will be appreciated that the injector has a relatively low dead volume. In one embodiment the maximum displacement of the pin 128 increases the injector system dead volume approximately 50 cubic millimeters. In addition, the fuel subtraction chamber 134 is effectively isolated from the nozzle chamber 45.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. An electronic unit injector comprising: injector body means for forming a fuel inlet, an injector chamber and an inlet passage connecting said fuel inlet and said injector chamber;

nozzle means for defining a nozzle chamber in fluid communication with said injector chamber, discharge orifice means and a valve seat;

needle valve means including a needle valve mounted in said nozzle means and axially displaceable in response to pressure above a first pre-established threshold in said nozzle chamber from a closed position wherein the needle valve engages the valve seat to prevent the discharge of fuel through said orifice means to an opened position wherein fuel in said nozzle chamber is discharged through said orifice means;

plunger means including a plunger displaceable in said injector chamber for pressurizing fuel therein;

expandable chamber means comprising means defining an expandable subtraction chamber in fluid communication with said injector chamber during the pressurization of fuel by said plunger means and means for expanding the volume of said subtraction chamber as the pressure in said subtraction chamber increases between second and third threshold pressures; and solenoid valve means mounted to said body means and actuable between first and second positions for selectively controlling fluid communication through said inlet passage wherein in the first position fuel communicates from said inlet passage to fill and spill said injector chamber and in a second position fuel communication between said inlet passage and injector chamber is terminated and said plunger is displaceable to pressurize fuel in said injector chamber so that when fuel in said nozzle chamber exceeds said first threshold pressure, fuel is discharged through said discharge orifice means in substantially a two-phase fuel injection rate sequence which is terminated by actuating said solenoid valve means to said first position.

2. The unit injector of claim 1 wherein the expandable chamber means comprises a pin having first and second ends, said first end being exposed to pressure in said subtraction chamber, said pin being displaceable for defining the volume of the subtraction chamber.

3. The electronic unit injector of claim 2 further comprising a cap mounted to said injector body means, said pin second end being engageable against said cap at said third threshold pressure.

4. The electronic unit injector of claim 3 wherein the cap defines an auxiliary accumulator chamber, said accumulator chamber receiving pressurized fuel which leaks past said pin from said subtraction chamber, said second pin end being exposed to pressure in said auxiliary accumulator chamber.

5. The electronic unit injector of claim 1 wherein said solenoid valve means comprises a spool valve and a solenoid which selectively controls the position of said spool valve.

6. The electronic unit injector of claim 5 further comprising means defining a port in said inlet passage, said spool valve closing said port when the solenoid is energized to actuate said spool valve to said second position.

7. An electronic unit injector comprising:

injector body means for forming a fuel inlet, an injector chamber and an inlet passage connecting said fuel inlet and said injector chamber;

nozzle means for defining discharge orifice means, a valve seat and a nozzle chamber in fluid communication with said injector chamber;

first valve means including a valve member mounted in said nozzle means and axially displaceable in response to pressure above a first pre-established threshold in said nozzle chamber from a closed position wherein the valve member engages the valve seat to prevent the discharge of fuel through said orifice means to an opened position wherein fuel in said nozzle chamber is discharged through said orifice means;

plunger means for pressurizing fuel in said injector chamber;

expandable chamber means comprising means defining an expandable subtraction chamber in fluid communication with said injector chamber and means for expanding the volume of said subtraction chamber as the pressure in said injector increases between a second and a third threshold pressure, said expandable chamber means comprising a pin having first and second ends, said first end being exposed to pressure in said subtraction chamber and said pin being displaceable for defining the volume of the subtraction chamber; and second valve means mounted to said body means for selectively controlling fluid communication through said inlet passage, so that as fuel pressurization in said injector chamber increases, the pressure in said subtraction chamber increases and the volume of said subtraction chamber expands until said third threshold pressure is attained whereby pressurized fuel is injected through said discharge orifice means in substantially a two-phase rate of injection sequence wherein the rate of injection of fuel in said first phase is significantly less than the rate of injection of fuel in said second phase, and the attainment of said third threshold pressure generally defines the transition between said first and second phases.

8. The electronic unit injector of claim 7 wherein the expandable chamber means comprises a cap mounted to said body means and a pin displaceable in said cap and engageable against said cap to define the third threshold pressure.

9. The electronic unit injector of claim 8 wherein the cap defines an accumulator chamber, said first pin end being exposed to pressure in said subtraction chamber and said second pin end being exposed to pressure in said accumulator chamber.

10. The electronic unit injector of claim 7 further comprising means defining a port interposed in said inlet passage and said second valve means further comprises a spool valve which is selectively positionable to close said port to prevent fluid communication therethrough and to open said port to permit communication therethrough.

11. The electronic unit injector of claim 10 wherein said spool valve is positioned in the open position to fill said injector chamber, is positioned in the closed position during the injection sequence, and is re-positioned in the open position to terminate the two-phase injection sequence.

12. The electronic unit injector of claim 7 wherein said means for expanding said subtraction chamber comprises a member which is displaceable between a retracted and an expanded position and further comprising return means for returning said member to the retracted position.

13. The electronic unit injector of claim 7 wherein the subtraction chamber is isolated from said nozzle chamber.

14. The electronic unit injector of claim 7 further comprising fluid passage means for providing fluid communication between said injector chamber and said nozzle chamber, said second valve means being interposed in said fluid passage means.

15. An electronic unit injector comprising:

injector body means for forming a fuel inlet, an injector chamber and an inlet passage connecting said fuel inlet and said injector chamber;

nozzle means for defining discharge orifice means, a valve seat and a nozzle chamber in fluid communication with said injector chamber;

first valve means including a valve member mounted in said nozzle means and axially displaceable in response to pressure above a first pre-established threshold in said nozzle chamber from a closed position wherein the valve member engages the valve seat to prevent the discharge of fuel through said orifice means to an opened position wherein fuel in said nozzle chamber is discharged through said orifice means;

plunger means for pressurizing fuel in said injector chamber;

expandable chamber means comprising means defining an expandable subtraction chamber in fluid communication with said injector chamber and means for expanding volume of said subtraction chamber as the pressure in said injector increases between a second and a third threshold pressure, said expandable chamber means comprising a cap mounted to said body means and a pin displaceable in said cap and engageable against said cap to define the third threshold pressure; and second valve means mounted to said body means for selectively controlling fluid communication through said inlet passage, so that as fuel pressurization in said injector chamber increases, the pressure in said subtraction chamber increases and the volume of said subtraction chamber expands until said third threshold pressure is attained whereby pressurized fuel is injected through said discharge orifice means in substantially a two-phase rate of injection sequence wherein the rate of injection of fuel in said first phase is significantly less than the rate of injection of fuel in said second phase, and the attainment of said third threshold pressure generally defines the transition between said first and second phases.

16. The electronic unit injector of claim 15 wherein the pin has first and second ends and the cap defines an accumulator chamber, said first pin end being exposed to pressure in said subtraction chamber and said second pin being exposed to pressure in said accumulator chamber.

17. The electronic unit injector of claim 16 wherein the pin is displaceable between a retracted position and an expanded position and pressure in said accumulator chamber forces said pin to return to the retracted position.

* * * * *